US007963754B2

(12) United States Patent
Hansen et al.

(10) Patent No.: US 7,963,754 B2
(45) Date of Patent: Jun. 21, 2011

(54) HYDRAULIC MACHINE

(75) Inventors: Kim René Hansen, Soenderborg (DK); Claus Jesper Johansen, Soenderborg (DK); René Schibsbye Andersen, Sydals (DK)

(73) Assignee: Sauer-Danfoss ApS, Nordborg (DE)

( * ) Notice: Subject to any disclaimer, the term of this patent is extended or adjusted under 35 U.S.C. 154(b) by 1636 days.

(21) Appl. No.: 10/504,835

(22) PCT Filed: Feb. 27, 2003

(86) PCT No.: PCT/DK03/00124

§ 371 (c)(1),
(2), (4) Date: Mar. 31, 2005

(87) PCT Pub. No.: WO03/074874

PCT Pub. Date: Sep. 12, 2003

(65) Prior Publication Data

US 2005/0180873 A1 Aug. 18, 2005

(30) Foreign Application Priority Data

Mar. 5, 2002 (DE) ..... 102 09 672

(51) Int. Cl.
*F03C 2/00* (2006.01)
*F03C 4/00* (2006.01)
*F04C 2/00* (2006.01)

(52) U.S. Cl. ..... 418/61.3; 418/189

(58) Field of Classification Search ..... 418/61.3, 418/78, 166, 171, 188, 190
See application file for complete search history.

(56) References Cited

U.S. PATENT DOCUMENTS

| | | | | | |
|---|---|---|---|---|---|
| 2,657,638 | A | * | 11/1953 | English | 418/173 |
| 3,606,601 | A | * | 9/1971 | White, Jr. et al. | 418/61.3 |
| 3,775,031 | A | | 11/1973 | Hansen | |
| 3,876,343 | A | | 4/1975 | Giversen | |
| 4,145,167 | A | | 3/1979 | Baatrup | |
| 4,390,329 | A | | 6/1983 | Thorson | |
| 4,859,160 | A | | 8/1989 | White, Jr. | |
| 5,215,453 | A | * | 6/1993 | Petersen et al. | 418/61.3 |
| 6,126,424 | A | * | 10/2000 | Wenker et al. | 418/61.3 |

FOREIGN PATENT DOCUMENTS

| | | |
|---|---|---|
| EP | 0 959 248 A2 | 11/1999 |
| JP | 9264494 | 10/1997 |

* cited by examiner

*Primary Examiner* — Theresa Trieu
(74) *Attorney, Agent, or Firm* — McCormick, Paulding & Huber LLP

(57) ABSTRACT

The invention concerns a hydraulic machine with a set of teeth, having a toothed ring with an inner toothing and a gear wheel with an outer toothing, the gear wheel rotating and orbiting in the toothed ring, the inner toothing and the outer toothing touching each other in contact areas, thus separating pressure chambers, and with a valve arrangement controlling a connection between a connection arrangement having a high pressure connection and a low pressure connection, and the pressure chambers. It is endeavoured to achieve a stable operation, particularly with low speeds. For this purpose, each contact area is provided with an opening, which, at the time when a pressure chamber reaches an extreme value of its volume, produces a short-circuiting with the neighbouring pressure chamber.

10 Claims, 4 Drawing Sheets

HYDRAULIC MACHINE

CROSS-REFERENCE TO RELATED APPLICATIONS

This application is entitled to the benefit of and incorporates by reference essential subject matter disclosed in International Application No. PCT/DK03/00124 filed on Feb. 27, 2003 and German Patent Application No. 10209672.4 filed on Mar. 5, 2002.

FIELD OF THE INVENTION

The present invention concerns a hydraulic machine with a set of teeth, having a toothed ring with an inner toothing and a gear wheel with an outer toothing, the gear wheel rotating and orbiting in the toothed ring, the inner toothing and the outer toothing touching each other in contact areas, thus separating pressure chambers, and with a valve arrangement controlling a connection between a connection arrangement having a high pressure connection and a low pressure connection, and the pressure chambers.

BACKGROUND OF THE INVENTION

A hydraulic machine of this kind is, for example, known from EP 0 959 248 A2. During motor operation, the valve arrangement supplies the expanding pressure chambers with pressurised hydraulic fluid from the hydraulic connection, whereas the contracting chambers are connected with the low-pressure connection via the valve arrangement, so that the hydraulic fluid from the contracting pressure chambers can be displaced. When the machine is operated as a pump, the valve arrangement connects the contracting pressure chambers with the high-pressure connection and the expanding chambers with the low-pressure connection.

In such machines, it is important that the supply to the individual pressure chambers is controlled relatively accurately by the valve arrangement. This is particularly crucial, when a transition from an expansion phase to a contraction phase occurs in a pressure chamber, that is, when the pressure chamber has reached its maximum volume or its minimum volume.

The known machine has a secondary commutation, which ensures that any pressure chamber has a connection outside the valve arrangement to any neighbouring pressure chambers until shortly before it reaches a minimum or a maximum volume. At the instant of the commutation it is ensured that there is no connection between the pressure chamber with maximum or minimum volume and the corresponding neighbouring pressure chambers. Thus, a stable operation with low speeds and high pressures is achieved.

A hydraulic machine as mentioned in the introduction, which is also called a gerotor machine, drives a valve element of the valve arrangement, which influences the correct positioning of the supply of the pressure chambers, via a cardan shaft or via another coupling arrangement. For several reasons, this may cause a small angle displacement between the valve element and the gear wheel that drives the valve element. Under certain circumstances, this angle displacement may cause that the pressure chambers are not connected with the corresponding supply connections in the correct position. This causes an instable operation, and in the extreme it may even lead to a damaging of the machine.

The invention is based on the task of achieving a stable operation, particularly with low speeds under high loads.

SUMMARY OF THE INVENTION

In a hydraulic machine of the kind mentioned in the introduction, this task is solved in that each contact area is provided with an opening, which, at the time when a pressure chamber reaches an extreme value of its volume, produces a short-circuiting with the neighbouring pressure chamber.

Thus, a second commutation is achieved, which ensures that impermissible pressure peaks in the pressure chambers can be avoided. Avoiding the pressure peaks is independent of whether or not the valve arrangement does actually ensure that the supply of the pressure chambers takes place in the correct position. Of course, also the control of the valve arrangement has certain limits, which cannot be exceeded. On transition from an expansion phase to a contraction phase or vice versa, the opening ensures that also with a slightly incorrect control by the valve arrangement a pressure equalisation can take place between neighbouring pressure chambers. This will cause a short-circuiting between the high-pressure side and the low-pressure side. Until now, it has always been endeavoured to avoid such a short-circuiting. As, however, this short-circuiting is only exposed to the highest pressure difference for a relatively short period, and as it is possible to have a certain influence on the amount of penetrating fluid by means of the size of the opening, the damaging effects of such a short-circuiting are extremely small. The positive effects achieved by the pressure equalisation completely neutralise these damaging effects.

It is particularly preferred that the opening is a throttle opening. Thus, the "loss" of hydraulic fluid flowing through the throttle opening can be kept small. This causes an increase of the volumetric efficiency.

Preferably, the throttle opening has a variable throttling resistance, which is largest at the moment, when the pressure chamber has an extreme value of its volume. This gives a gradual throttling of the fluid flow between neighbouring pressure chambers until the time, when one of the two pressure chambers assumes its maximum or its minimum volume. Thus, an additional pressure surge is avoided, which could occur, when suddenly a throttle was inserted in this fluid path. Anyway, the fluid loss at the moment of commutation is kept small.

Preferably, the opening is formed by a recess in a tooth side. This is a relatively easy way of producing such an opening. A recess is easily made, for example by milling.

Preferably, the recess is made in the outer toothing. The outer toothing is often made by means of a moulding of the gear wheel, whereas the teeth of the inner toothing of the toothed ring are often in the shape of rollers, which can rotate in the toothed ring. When the recess is made in the outer toothing, it has a fixed position, which does not change in relation to the toothing geometry.

Preferably, the recess has a plane or concavely arched bottom. A recess of this kind is easily made, for example by milling. A plane bottom is made by a milling cutter. Depending on the diameter of the disc, a side-milling cutter can, under certain circumstances, produce a concavely arched bottom. As the remaining tooth side is arched, this will result in a gradually increasing depth of the recess. This is a simple way of achieving a variable throttle resistance, which reaches its highest value, when the pressure chamber in question has reached its maximum or its minimum volume.

Preferably, the recess is arranged in the axial centre of the toothing. Thus, possibly occurring asymmetric forces on the toothed set can be avoided. In the axial direction, the recess is relatively short. Accordingly, enough space for arranging the recess is available in the axial centre of the toothing.

Preferably, a recess is arranged on either side of a tooth. Thus, the machine can be driven independently of the rotation direction. In all cases, it is ensured that, when reaching the minimum volume or the maximum volume of a pressure chamber, a connection to the neighbouring pressure chamber exists, through which a pressure can be built up.

Preferably, the valve arrangement has a rotatably driven valve plate, which is supported in a substantially plane manner on a channel plate. Compared with a drum slide valve, a plane slide valve of this kind has the advantage that it can work with a smaller play, thus having an improved tightness. However, it must be ensured that during operation the balance of the valve plate is as good as possible, to avoid a too heavy wear caused by friction in relation to the channel plate.

It is preferred that the valve plate is loaded in the direction of the channel plate by a spring-biased balancing plate. The spring biasing ensures the sealing between the valve plate and the channel plate during start-up. Later, the force in the direction of the channel plate is ensured by the oil pressure, which builds up inside the machine.

BRIEF DESCRIPTION OF THE DRAWINGS

In the following, the invention is described in detail on the basis of a preferred embodiment in connection with the drawings, showing:

FIG. 2 is a section II-II according to FIG. 1

DETAILED DESCRIPTION OF THE PREFERRED EMBODIMENTS

Figure 1:
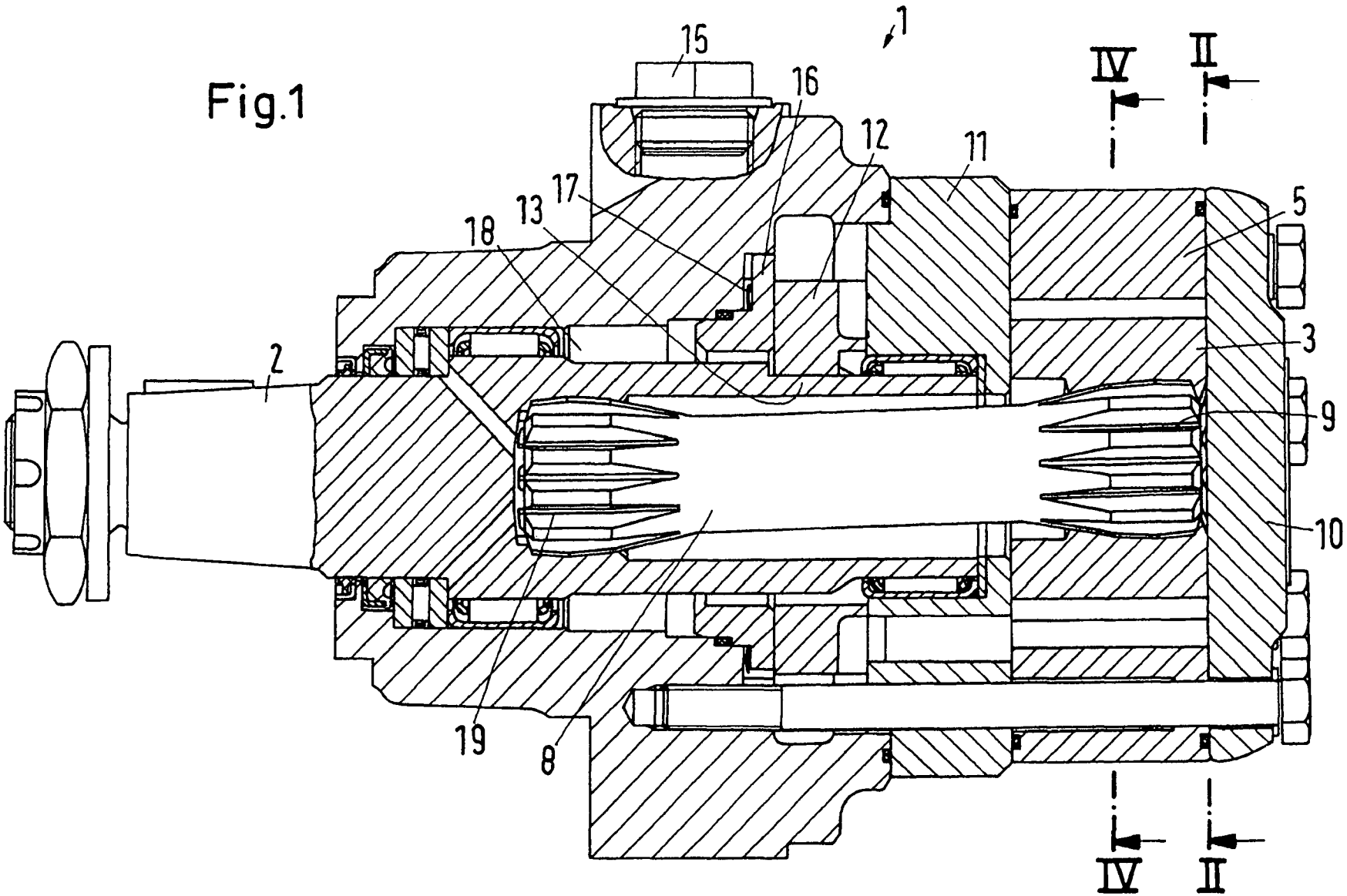
FIG. 1 is a longitudinal section through a hydraulic machine

A machine shown in FIG. 1 is in the form of a motor 1, which has an output shaft 2. The output shaft 2 is driven by a gear wheel 3, which has an outer toothing 4 an rotates and orbits in a toothed ring 5, which has an inner toothing 6 in the shape of rollers 7. The output shaft 2 is connected with the gear wheel 3 via a cardan shaft 8, which is inserted into a suitable toothing 9 in the inside of the gear wheel 3.

On the side facing away from the cardan shaft 8, the toothed set consisting of the gear wheel 3 and the toothed ring 5 is covered by a cover plate 10. On the opposite side, the toothed set is covered by a channel plate 11, which cooperates with a valve plate 12. The valve plate 12 engages with an extension 13 of the output shaft 2, so that the valve plate 12 rotates synchronously with and at a predetermined angle relation to the gear wheel 3.

Together, the channel plate 11 and the valve plate 12 form a valve arrangement, which controls the supply from a connection arrangement 15 of the pressure chambers 14, which are formed between gear wheel and toothed ring 5 (FIG. 2), only one connection of the connection arrangement 15 being visible in FIG. 1. The connection arrangement 15 has a high-pressure connection, at which pressurised hydraulic fluid is supplied into the motor, and a low-pressure connection, through which the hydraulic fluid can flow off from the motor.

In order to ensure the tightness between the valve plate 12 and the channel plate 11, a balancing plate 16 is provided, which is arranged on the side of the valve plate 12 facing the channel plate 11. This ensures the corresponding tightness between the channel plate 11 and the valve plate 12 during start-up. Later, the required force on the valve plate 12 is provided by a pressure in a pressure chamber 18, in which a corresponding oil pressure builds up during operation of the motor.

The cardan shaft 8 is connected with the output shaft 2 by means of an additional toothing 19. Neither with the toothing 9 nor with the toothing 19 a play can be completely avoided. Particularly in connection with high loads, it is further possible that the cardan shaft 8 gets twisted. The sum of these occurrences now contribute to the fact that the supply in the correct position of the individual pressure chambers 14 between the toothed ring 5 and the gear wheel 3 is no longer ensured in the way, which is actually required.

Problems particularly occur, when the volume of a pressure chamber 14 has reached its maximum value, and after passing this maximum value, the pressure chamber starts contracting. In this case it is required that a connection exists between this pressure chamber and the outlet or low-pressure connection. If, however, at this instant the pressure chamber is still connected with the high-pressure connection, pressure surges occur, which have a negative effect on the operational behaviour of the machine. This is particularly the case in connection with low speeds. The same problem occurs, when the volume in the pressure chamber 14 has passed a minimum value and starts expanding. In this case, a connection with the high-pressure connection is required. When this pressure chamber is still connected with the low-pressure connection, there is a risk of cavitations. This means that problems always occur, when a pressure chamber assumes an extreme value of its volume.

Figure 3:
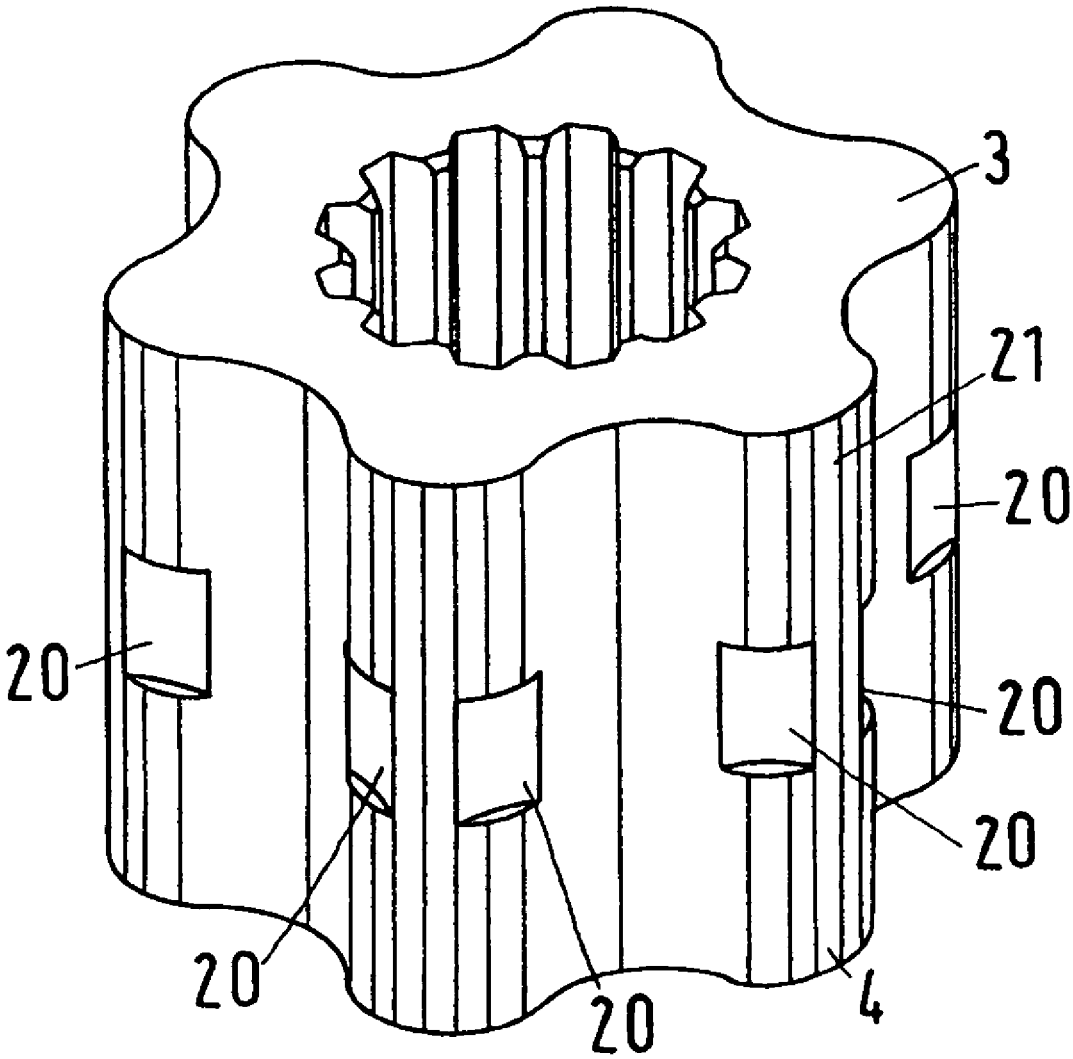
FIG. 3 is a perspective view of a gear wheel

In order to remedy these problems, the gear wheel 3 is, as shown in FIG. 3, provided with recesses 20 on the sides of the teeth 21 forming the outer toothing 4. The recesses 20 are arranged approximately in the axial centre of the gear wheel. They have an axial extension in the range from 15 to 20% of the axial length of the gear wheel 3. Their extension in the circumferential direction will be explained in connection with the FIGS. 4 to 7.

Figure 4:
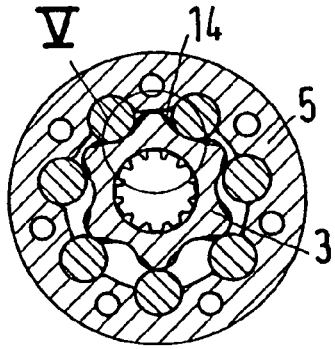
FIG. 4 is a cross-section IV-IV according to FIG. 1 in one position of the gear wheel

FIG. 4 shows a cross-section IV-IV according to FIG. 1.

Figure 5:
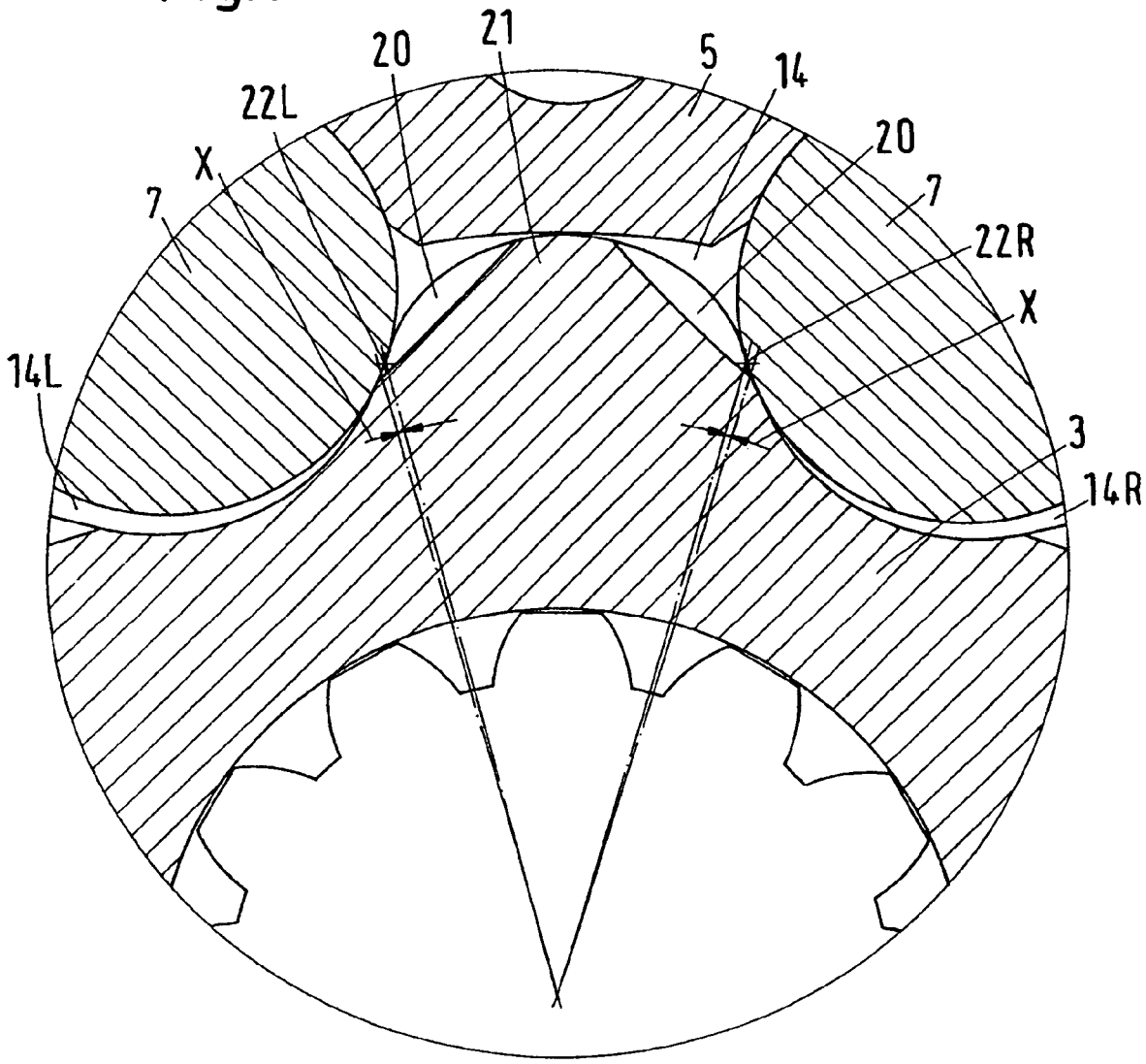
FIG. 5 is an enlarged section V of FIG. 4

FIG. 5 shows an enlarged section V according to FIG. 4.

FIG. 4 shows a situation, in which the gear wheel 3 assumes a position in relation to the toothed ring 5, in which the upper (referring to the view in the Fig.) pressure pocket 14 has its minimum volume. As this state will appear for each pressure pocket, it will be sufficient to explain the circumstances for one pressure pocket 14.

The tooth 21 of the gear wheel 3, which is in the pressure pocket, forms, together with the neighbouring rollers 7 of the toothed ring 5, substantially line-shaped contact areas 22R, 22L, in the following called contact lines. In these contact lines 22R, 22L the tooth 21 and the rollers 7 bear on each other in such a way that here the pressure chamber 14 is sealed in relation to a pressure chamber 14L on the left side and a pressure chamber 14R on the right side.

When now the gear wheel 3 would continue to rotate, the pressure chamber 14 would expand. When, at this moment, the valve arrangement 11, 12 has not yet established a connection with the high-pressure connection, hydraulic fluid cannot flow into the pressure chamber 14 during an expansion. A risk of cavitations exists.

In order to counteract this risk, the two recesses 20 have a length in the circumferential direction of the gear wheel 3, that is, they have an extension, which permits them to exceed the contact lines 22L, 22R. Thus, the recesses 20 provide a connection between the pressure chamber 14 and the left pressure chamber 14L on the one side and between the pressure chamber 14 and the right pressure chamber 14R on the other side. In this connection, the recesses 20 extend by a distance X into the neighbouring pressure chambers 14L, 14R. Accordingly, they create a "short-circuiting" between the pressure chamber 14 and the neighbouring chambers 14L, 14R. Only a small amount of fluid is lost through this short-circuiting, as at this point the recess 20 is not particularly deep. Together with the gear wheel 3 and the rollers 7 of the inner toothing 6 the recess 20 forms a throttle, whose throttling resistance is variable. The throttling resistance has its highest value, when the pressure chamber 14 starts expanding.

However, the connection between the pressure chamber 14 and the neighbouring pressure chambers 14L, 14R created by the recesses is sufficient to equalise the pressure peaks, which could occur, when the pressure chamber starts expanding. Pressure peaks here also mean negative pressure peaks.

The contact lines 22L, 22R between the tooth 21 and the rollers 7, which occur in the position of the gear wheel 3 in relation to the toothed ring 5 shown in FIG. 4, in which position the pressure chamber 14 has its smallest volume, determine the extension of the recesses 20 in the direction of the tooth bottom of the gear wheel 3.

The extension of the recesses 20 in the direction of the tooth peak will be explained on the basis of FIGS. 6 and 7.

Figure 6:
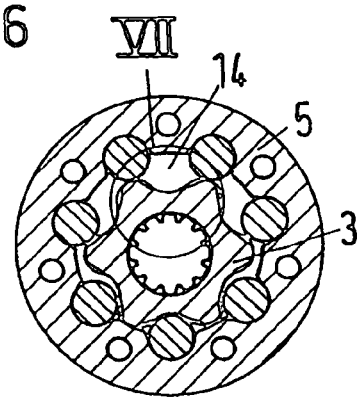
FIG. 6 is a view according to FIG. 4 with another position of the gear wheel
Figure 7:
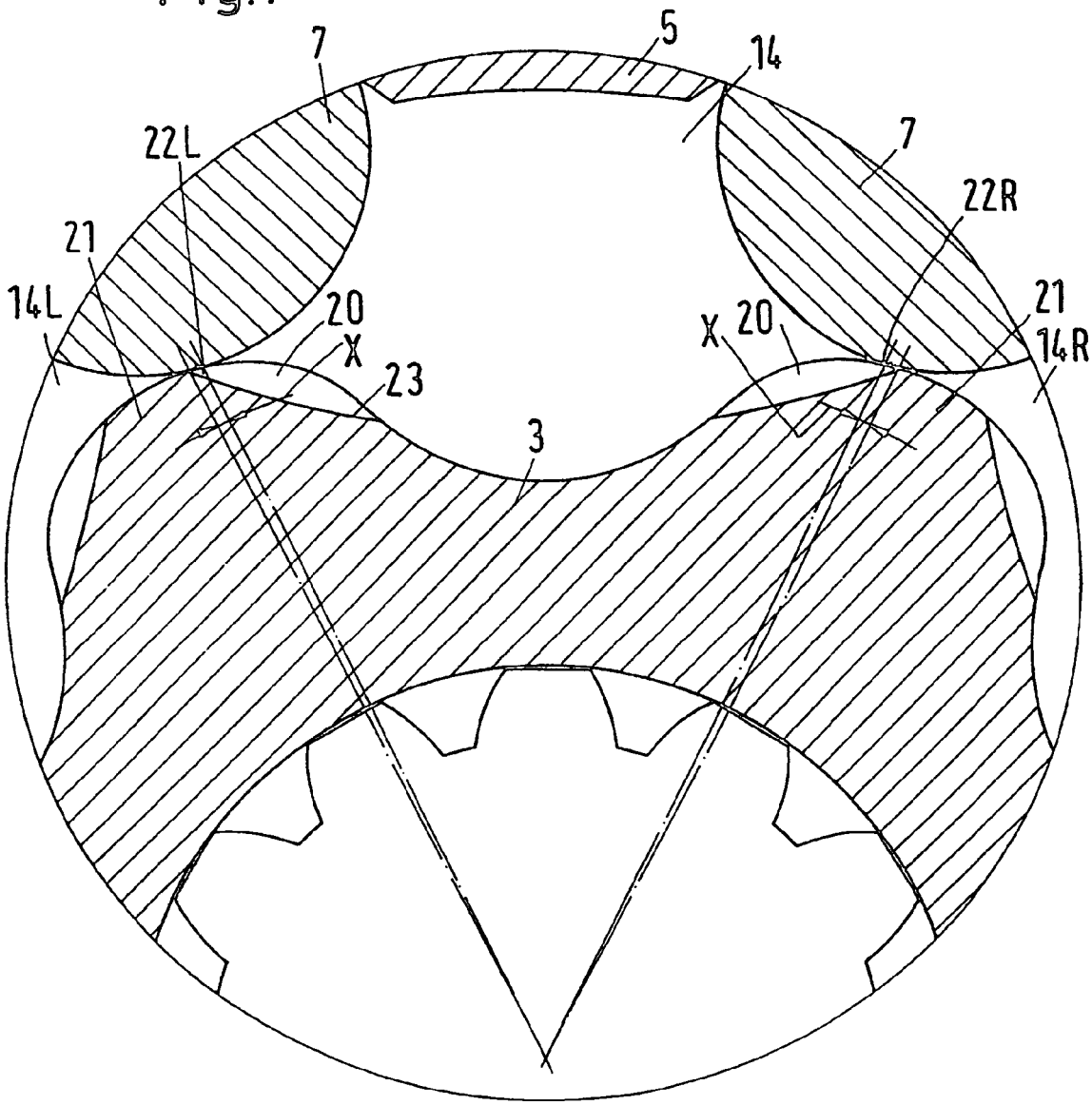
FIG. 7 shows an enlarged section VII according to FIG. 6

FIG. 6 shows a view according to FIG. 3, in which the gear wheel 3 now has assumed a position in relation to the toothed ring 5, in which the pressure chamber 14 has its maximum volume. A further rotation of the gear wheel 3 in relation to the toothed ring 5 will force the pressure chamber to contract. When, at this instant, a connection from this pressure chamber 14 to the low pressure connection has not yet been established through the valve arrangement 11, 12, impermissible pressure peaks would occur in the pressure chamber 14, which would, in the best case, cause an unstable operation of the machine, in the worst case, however, damage the machine.

In order to remove or weaken these pressure peaks, the recesses 20 in the circumferential direction of the gear wheel 3 have been made so long that they project over the contact lines 22L, 22R of the teeth 21 with the rollers 7 by a distance X. This again creates a short-circuiting between the pressure chamber 14 and the neighbouring chambers 14L, 14R, through which hydraulic fluid can escape from the pressure chamber 14, when this pressure chamber starts contracting.

A short-circuiting of this kind between a pressure chamber 14 under high pressure and neighbouring pressure chambers 14L, 14R, of which one is connected with the low-pressure connection, is usually undesirable. When, however, this short-circuiting is dimensioned in such a way that, on the one hand, pressure peaks can be reduced, and, on the other hand, not too much fluid under high pressure is lost, the advantages of a stable operation will occur, particularly with low speeds under high load, without causing a significant reduction of the volumetric efficiency.

Instead of the valve arrangement with a valve plate 11 and a channel plate 12, which bear on each other in a plane manner, it is also possible to use a valve arrangement, made with two rotary slides, which are concentrically inserted in each other.

The production of a recess 20 is relatively simple. It is sufficient to dive a suitable tool, for example a cutter, into the corresponding tooth sides of the teeth 21. At the same time, this gives the recess 20 a straight or concavely arched bottom 23, which, in cooperation with the remaining tooth shape, ensures that from its edges the recess has a continuously increasing depth and thus a reducing throttling resistance.

What is claimed is:

1. A hydraulic machine having a set of teeth, said hydraulic machine comprising:

a toothed ring with an inner toothing, a gear wheel with an outer toothing, the gear wheel rotating and orbiting in the toothed ring, the inner toothing and the outer toothing touching each other in contact areas, thus separating pressure chambers, a valve arrangement controlling a connection between a connection arrangement having a high pressure connection and a low pressure connection and the pressure chambers, each contact area being provided with an opening, which, at the time when a pressure chamber reaches an extreme value of its volume, produces a short-circuit with the neighbouring pressure chamber.

2. A hydraulic machine according to claim 1, wherein the opening is a throttle opening.

3. A hydraulic machine according to claim 2, wherein the throttle opening has a variable throttling resistance, which is largest at the moment, when the pressure chamber reaches an extreme value of its volume.

4. A hydraulic machine according to claim 1, wherein the opening is formed by a recess in a tooth side.

5. A hydraulic machine according to claim 4, wherein the recess is made in the outer toothing.

6. A hydraulic machine according to claim 4, wherein the recess has a plane or concavely arched bottom.

7. A hydraulic machine according to claim 4, wherein the recess is arranged in the axial centre of the toothing.

8. A hydraulic machine according to claim 4, wherein a recess is arranged on either side of a tooth.

9. A hydraulic machine according to claim 1, wherein the valve arrangement has a rotatably driven valve plate, which is supported in a substantially planar manner on a channel plate.

10. A hydraulic machine according to claim 9, wherein the valve plate is loaded in the direction of the channel plate by a spring-biased balancing plate.

* * * * *